US012692770B2

(12) United States Patent
Taha et al.

(10) Patent No.: US 12,692,770 B2
(45) Date of Patent: Jul. 28, 2026

(54) MITIGATING FLOW VARIABILITY AND SLUGGING IN PIPELINES

(71) Applicant: Saudi Arabian Oil Company, Dhahran (SA)

(72) Inventors: Othman Taha, Dhahran (SA); Ariffen Bin Adnan, Dhahran (SA); Yuk San Man, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 621 days.

(21) Appl. No.: 18/341,488

(22) Filed: Jun. 26, 2023

(65) Prior Publication Data

US 2024/0003232 A1 Jan. 4, 2024

Related U.S. Application Data

(60) Provisional application No. 63/357,044, filed on Jun. 30, 2022.

(51) Int. Cl.
*E21B 43/12* (2006.01)
*E21B 47/12* (2012.01)

(52) U.S. Cl.
CPC ..... *E21B 43/12* (2013.01); *E21B 47/138* (2020.05)

(58) Field of Classification Search
CPC .. E21B 2200/09; E21B 2200/22; E21B 43/12; E21B 47/138
See application file for complete search history.

(56) References Cited

U.S. PATENT DOCUMENTS

| | | | | |
|---|---|---|---|---|
| 6,716,268 | B2 | 4/2004 | Molyneux et al. | |
| 7,383,102 | B2 | 6/2008 | Coward | |
| 8,047,292 | B2 | 11/2011 | Ramachandran et al. | |
| 8,983,815 | B2 * | 3/2015 | Bleackley | G06F 30/13 703/6 |
| 9,347,284 | B2 | 5/2016 | Beg et al. | |
| 9,926,761 | B2 | 3/2018 | Massa De Campos et al. | |
| 10,024,499 | B2 | 7/2018 | Brenskelle | |
| 10,533,403 | B2 | 1/2020 | Lawrence et al. | |
| 12,481,253 | B2 * | 11/2025 | Alanazi | G06T 7/10 |
| 12,510,211 | B2 * | 12/2025 | Shao | F17D 5/005 |
| 2003/0010204 | A1 | 1/2003 | Molyneux et al. | |
| 2010/0011876 | A1 | 1/2010 | Vyas et al. | |

(Continued)

FOREIGN PATENT DOCUMENTS

| | | | | |
|---|---|---|---|---|
| CA | 3120164 | A1 * | 6/2020 | G06N 7/01 |
| KR | 1020200056063 | | 5/2020 | |

(Continued)

OTHER PUBLICATIONS

Havre et al., "Taming Slug Flow in Pipelines," ABB Review, Dec. 2000, 4:55-63, 9 pages.

(Continued)

*Primary Examiner* — Scott T Baderman
*Assistant Examiner* — Mario M Velez-Lopez
(74) *Attorney, Agent, or Firm* — Fish & Richardson P.C.

(57) ABSTRACT

Systems and methods for mitigating flow variability and slugging in pipelines (e.g., trunk-lines leading to gas-oil separation plants (GOSP)) use supervised machine learning algorithms to develop operational strategies for controlling inflows to facilities such as GOSPs.

8 Claims, 9 Drawing Sheets

(56) References Cited

U.S. PATENT DOCUMENTS

| | | | | |
|---|---|---|---|---|
| 2012/0048000 | A1* | 3/2012 | Kirzhner | F02M 37/0017 73/40.5 R |
| 2017/0076209 | A1* | 3/2017 | Sisk | G05B 23/0283 |
| 2021/0010839 | A1 | 1/2021 | Garooon et al. | |
| 2021/0181374 | A1* | 6/2021 | Sandnes | G06F 30/18 |
| 2023/0251628 | A1* | 8/2023 | Idris | E21B 41/00 700/266 |

FOREIGN PATENT DOCUMENTS

| | | |
|---|---|---|
| WO | WO 2009068692 | 6/2009 |
| WO | WO 2019110851 | 6/2019 |

OTHER PUBLICATIONS www.ni.com [online], "Shell Stabilizes Long Pipeline-Riser Gas/Liquid Flow," retrieved on Dec. 29, 2023, retrieved from URL <https://www.ni.com/pdf/csma/us/shellpg21.pdf>, 1 page.

International Search Report and Written Opinion in International Application No. PCT/US2023/026232, dated Oct. 11, 2023, 13 pages.

* cited by examiner

400

| | | | | | | |
|---|---|---|---|---|---|---|
| | | Start date: | 5/27/10 6:00AM | | End date: | 11/27/10 1:00PM |
| Maximum MOV Open% | 6 | | | | | |
| Minimum MOV close% | 6 | | Variability Mitigation Solution | | | |
| Flow fluatiation | | | Total Oilflow in TFI | | 888,946.9 | BBL/Day |

| Trunk Line | TA1 | TA2 | TA3 | TA4 | TA5 | TA6 |
|---|---|---|---|---|---|---|
| Tag name | B45P11102 PV | B45P11202 PV | B45P11302 PV | B45P11402 PV | B45P11502 PV | B45P11602 PV |
| Total flow in MMBD | 180,4617 | 56,549.8 | 190,516.7 | 0.0 | 55,2010 | 50,720.8 |
| STDEV | 1.37 | 121 | 5.75 | 1.66 | 0.87 | 1.06 |
| Significant STD | 9 | 9 | 5.75 | 0.00 | 0.00 | 0.00 |
| Contribution to deviation | 0.00 | 0.00 | 50.34 | 0.00 | 0.00 | 0.00 |

| | | |
|---|---|---|
| Target variability reduction | -10% | |

| | | | | | |
|---|---|---|---|---|---|
| ecommended mitigation | -5.99 | 72.09 | 0.066 | Reducation | -5.30794 |
| info maintaining the flow | -2.59 | 74.17 | | Addition flow | 5.30434 |
| | 2.50 | 72.10 | | | |

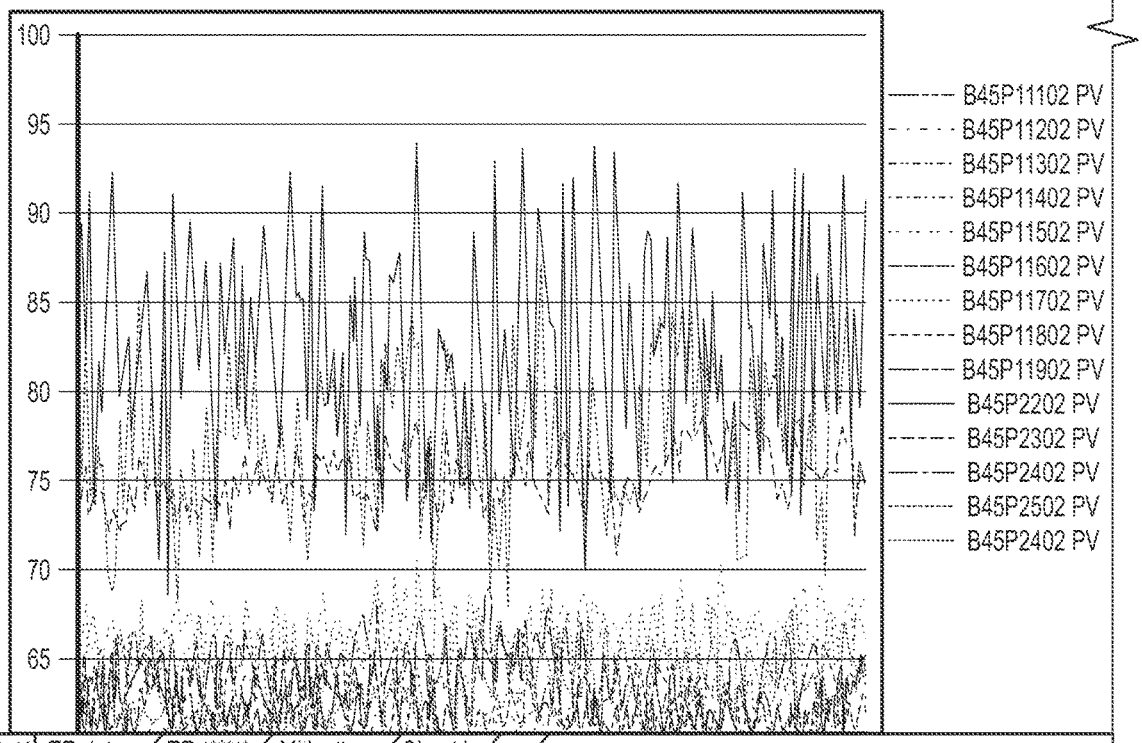

TR data / TR ****** / Mitigation / Sheet4

FIG. 5

| Sampling: | *** |
|---|---|

| TA7 | TA8 | TA9 | TA10 | TA11 | TA12 | TA13 | TA14 |
|---|---|---|---|---|---|---|---|
| B45P11702 PV | B45P11802 PV | B45P12002 PV | B45P12102 PV | B45P12202 PV | B45P12302 PV | B47P0061 PV | B47P10061 PV |
| 40,729.6 | 71,055.5 | 67,610.9 | 54,477Z2 | 44835.2 | 87,584.8 | 75,103.6 | 75,103.6 |
| 1.15 | 0.82 | 1.42 | 1.49 | 1.94 | 4.26 | 0.90 | 2.54 |
| 0.00 | 0.00 | 0.00 | 0.00 | 0.00 | 4.58 | 0.00 | 3.54 |
| 0.00 | 0.00 | 0.00PV | 0.00 | 0.00 | 33.57 | 0 | 21.03 |

| | | | |
|---|---|---|---|
| DDL/day | 3.19 | 72.06 | OPEN |
| DDL/day | 3.99 | 72.05 | |
| | 3.97 | 72.67 | |

| 7/15/2019 10:00 | | Flow STDEV | OT #1 | OT #2 | OT #3 | OT #4 | OT #5 |
|---|---|---|---|---|---|---|---|
| | | | 70.65 | 85.02 | 92.61 | 90.52 | 75.64 |
| 7/15/2019 13:00 | | Flow STDEV | OT #1 | OT #2 | OT #3 | OT #4 | OT #5 |
| | | | 56.26 | 72.35 | 79.73 | 75.33 | 62.95 |
| 7/15/2019 14:00 | | Flow STDEV | OT #1 | OT #2 | OT #3 | OT #4 | OT #5 |
| | | | 54.09 | 70.49 | 78.40 | 75.22 | 60.89 |

MITIGATING FLOW VARIABILITY AND SLUGGING IN PIPELINES

CROSS REFERENCE TO RELATED PATENT APPLICATIONS

This application claims the benefit of U.S. Provisional Application No. 63/357,044, filed Jun. 30, 2022, the contents of which are incorporated by reference herein.

TECHNICAL FIELD

The present disclosure generally relates to mitigating flow variability and slugging in pipelines.

BACKGROUND

Slugging is the accumulation of a water, oil or condensate in a gas pipeline. These fluids can removed, for example, using a pig. Slugging can be caused variations in flow, pipeline geometry, changes in terrain, and pigging or scraping a pipeline. Slugging can cause problems including pressure cycling, control instability, and inadequate phase separation. Slugging can be characterized as normal working condition slugging and pigging condition slug flow.

SUMMARY

This specification describes systems and methods for mitigating flow variability and slugging in pipelines (e.g., trunk-lines leading to gas-oil separation plants (GOSP)). These systems and methods use supervised machine learning algorithms (e.g., regression, decision tree models, recurrent neural networks (RNN), long short-term memory (LSTM) neural networks) to develop flowlines slugging models to predict slugging events ahead of time. These models will be then used to calculate actions controlling inflows to facilities such as GOSPs. These systems and methods have been used to develop a prototype system predicting flow variability and slugging, identifying strategies to control flow from specific trunk-lines to reduce flow variability and slugging, and choking specific trunk-lines using machine operated valves.

In one aspect, methods for controlling fluid flow for mitigation of flow variations upstream of a gas oil separation plant include: obtaining first sensor data associated with one or more trunk lines; obtaining second sensor data associated with a gas and oil separation plant (GOSP) configured to receive fluid from the one or more trunk lines; wherein the first and second sensor data are obtained for a first time period and a second time period that is different than the first time period; extracting one or more features from the first sensor data and the second sensor data based identified features of training data that trains a machine learning model associated with the GOSP, the training data comprising labeled data representing incoming feed gas of the GOSP, the labeled data associating upstream flow volumes, input flows, and operating conditions with incoming feed gas volumes; generating, from the extracted one or more features, a first feature vector for the first time period and a second feature vector for the second time period; processing, by a machine learning model, the first feature vector and the second feature vector, the machine learning model being trained with the training data; determining, based on the processing, predicted incoming feed gas volumes; and controlling, based on the predicted incoming feed gas volumes, settings of machine operated valves upstream of the GOSP. The methods can include one or more of the following features.

In some methods, extracting the features is based on principle component analysis of the training data comprising first sensor data and second sensor data. In some cases, the first sensor data includes values for process measurements including at least one of an upstream flow volume for each of the one or more trunk lines and an input flow volume from each of the one or more trunk lines. In some cases, the second sensor data includes one or more inlet manifold pressure values, one or more values of levels for oil, water, or gas, and a gas pressure value for at least one location in the GOSP.

In some methods, the first time period includes periods when crude trunk-line scraping activities are performed.

In some methods, controlling the settings of the machine operated valves upstream of the GOSP includes chocking the machine operated valves of one or more trunk lines.

In some methods, controlling the settings of the machine operated valves upstream of the GOSP includes directing certain trunk lines to a specific GOSP. In some cases, controlling the settings of the machine operated valves upstream of the GOSP includes splitting at least one trunk line into various GOSPs.

These systems and methods can reduce production instabilities that affect hydrocarbon processing facilities. This reduction is desirable because the production instabilities can lead to failures of internal components of high pressure production traps (HPPT), tripping of dehydrators and desalters leading to off spec production, and large flow variabilities increasing operator workloads. The production/process variabilities are particularly severe during crude trunk-line scraping activities (e.g., pigging). These systems and methods are based on identifying parameters with the most impact on flow variability and suggesting actions applied at the applicable process parameters to counter flow variability mechanisms. In particular, the systems and methods described herein include control systems configured to control flow during production of hydrocarbons at a production facility. For example, the control system is configured to identify values of process parameters affecting flow variability and perform actions to reduce flow variability. In some implementations the control can be performed in real time. In some implementations the control can be performed at a later time based on pre-processing of process parameter values.

The details of one or more embodiments of these systems and methods are set forth in the accompanying drawings and the description below. Other features, objects, and advantages of these systems and methods will be apparent from the description and drawings, and from the claims.

DESCRIPTION OF DRAWINGS

Like reference symbols in the various drawings indicate like elements.

DETAILED DESCRIPTION

This specification describes systems and methods for mitigating flow variability and slugging in pipelines (e.g., pipelines carrying hydrocarbons to GOSPs). These systems and methods use supervised machine learning algorithms (e.g., regression and decision tree models) to develop the operational strategies. A control system is configured for predicting and detecting slugging occurrences and causing remedial actions to reduce flow variability. The systems and method can include a control system configured to enable execution of operational control steps (e.g., choking specific trunk-lines) to reduce flow variability, maintain production rates, maintain an even distribution of water cut in oil trains and enhance safe operations (e.g., by avoid ESP trips) during hydrocarbon production at a facility.

Figure 1A:
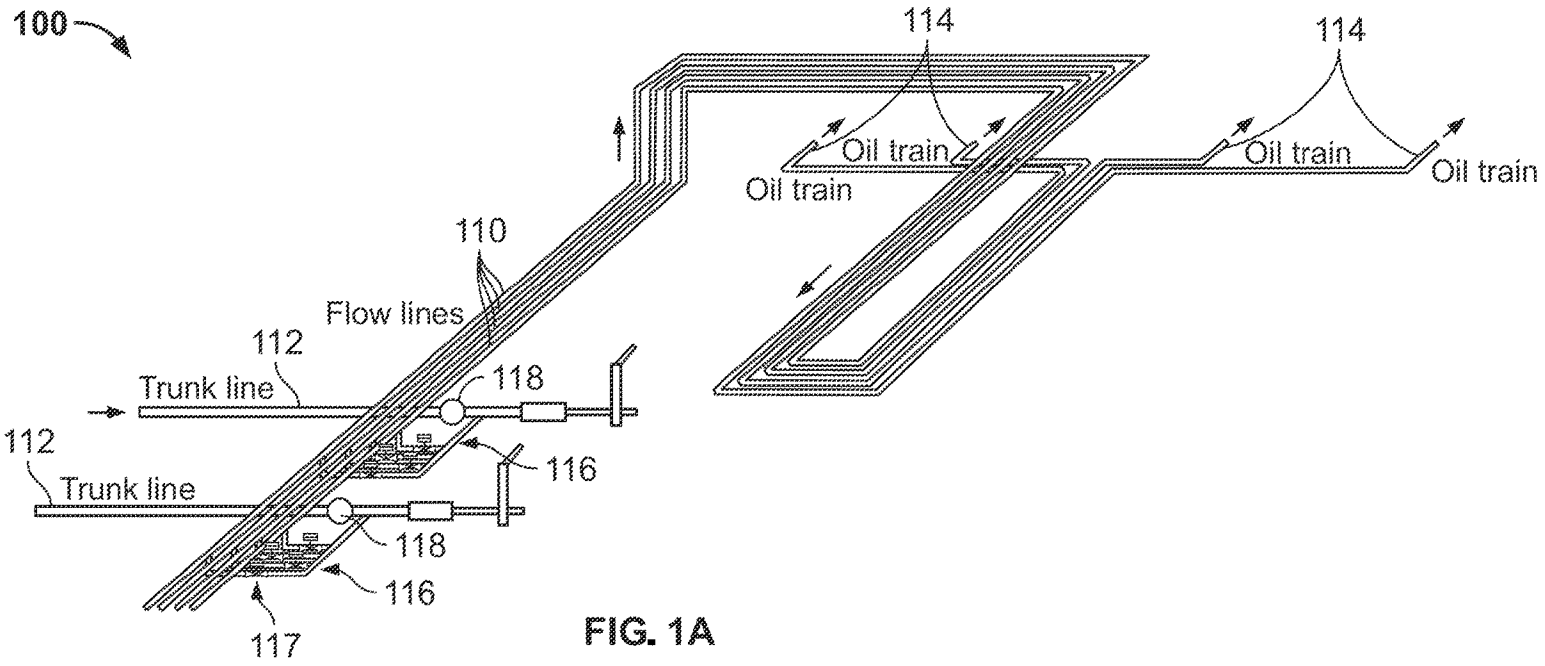
FIG. 1A is a schematic of manifolds connecting trunk-lines to an GOSP and FIG. 1B is a schematic illustrating one oil train of the GOSP.

FIG. 1A is a schematic of a system 100 with production headers 110 connecting trunk-lines 112 to GOSPs 114. The trunk-lines 112 carry feed from reservoirs (e.g., crude oil fields) to the production headers 110. Each trunk-line 112 is connected to all four of the production headers 110 by a manifold 116 associated with the trunk-line 112. Each manifold 116 includes machine operated valves (MOVs) 117 associated with individual production headers 110. Each trunk-line has 6 MOVs—one MOV per oil train header (4 in total) with one MOV to a depressurizing vessel. Similar approaches can be applied to systems with different numbers of oil trains and/or number of trunk-lines. Wet crude from the fields is transferred from the trunk-lines 112 to the manifolds via scraper receivers 118 at the end of the trunk-lines 112.

Systems typically include multiple trunk-lines 112 and multiple production headers 110 with each of the trunk-lines 112 connected to more than one of the multiple production headers 110. The system 100 has four production headers 110. Only two trunk-lines 112 are shown but the production headers 110 extend out of the field of view for connection to other production headers 110. This configuration allows automated control systems and/or system operators to direct certain trunk lines to a specific GOSP or to split each trunk line into various GOSPs. The multiple connection options provide ability to throttle or choke specific feeds and/or to combine the feeds from different trunk-lines to balance flows and/or mitigate slugging. The control system implementing processes for mitigating flow variability and slugging in the GOSP uses machine learning models to address the complexity of the system that make it difficult to systematically operate the overall system to provide this mitigation.

Different systems have different numbers of production headers and trunk-lines. For example, a prototype system implementing processes for mitigating flow variability and slugging in an GOSP was implemented and tested in a facility that included 14 trunk-lines carrying flow from three reservoirs to five production headers feeding the five GOSPs.

Figure 1B:
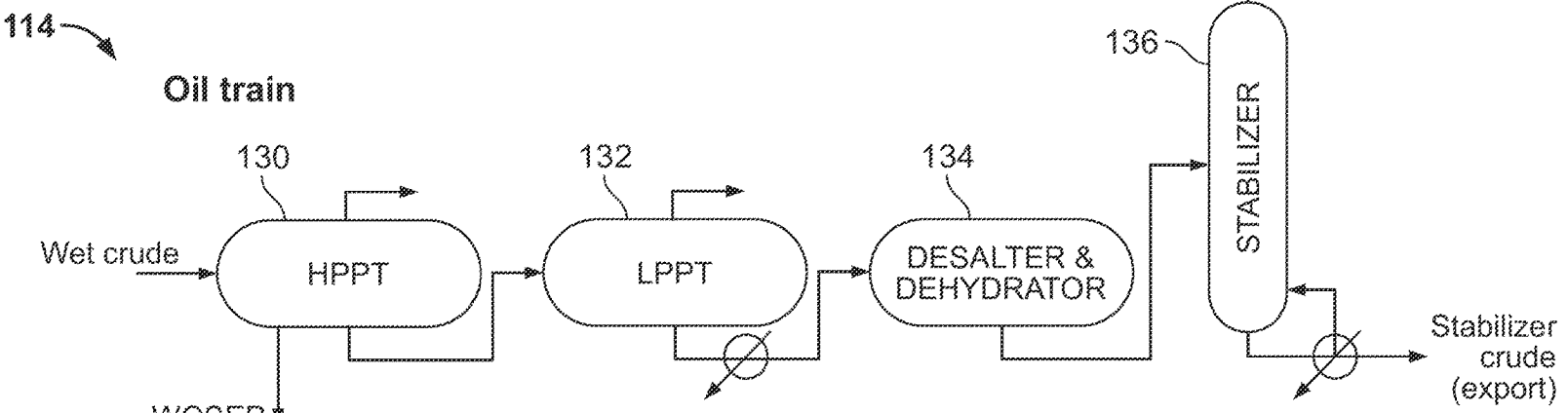

FIG. 1B is a schematic illustrating the oil train of one GOSP. GOSPs treat and upgrade wet crude oil into salable stabilized crude oil. Typical functions of the GOSPs are to separate hydrocarbon gases from crude oil, remove water from crude oil and reduce the salt, RVP and H2S contents in the crude oil to the acceptable levels. The oil train of the GOSP typically includes a high pressure production trap 130, a low pressure production trap 132, a dehydrator-desalter 134, and a stabilizer 136.

Process and system parameters (e.g., multi-phase flow meter volumetric flows of gas, oil and water, inlet manifold pressures, oil and water levels, and gas pressure) are measured at various locations through the GOSP. These parameters are used as input to the systems described with respect to FIGS. 2 and 3 and other plant control systems.

Wet crude from the trunk-line is routed to the HPPT 130 where it is separated into vapor, crude, and water phases which are processed in a gas train, an oil train, and a water train. For clarity of illustration, only the oil train is shown. The HPPT is designed to handle slugging flow conditions that often occur in the trunk-lines during start up or change in flow conditions.

Crude oil output from the high pressure production traps 130 flows to low pressure production traps (LPPT) 132. The LPPT 132 further separates the remaining crude oil at low pressure between oil and gas. The LPPT 132 also receives streams of oil, water and gas coming from other sections of the GOSP. In addition wet crude from HPPT 130, the LPPT 132 also receives recovered oil from the deoiling unit as well as off-spec crude from the dehydrator-desalter 134. Condensates from LP gas compressor and the desalter also forms part of the feed to the LPPT 132. The LPPT discharges the gas separated from the crude to a gas compressor suction drum and the degassed crude to the dehydrator 134 through the wet/dry heat exchangers via the crude charge pumps.

In the dehydrator-desalter 134, the desalter reduces the salt water content of the degassed crude coming from dehydrator. The vessel receives also fresh water from wash water pumps in order to decrease the salt concentration in the liquid phase. The desalted crude is sent to the crude stabilizer 136, while the salt water is recycled to the WOSEP through desalter water transfer pumps.

Crude from the desalter is fed to the top of the column of the crude stabilizer 136. The column has two reboilers, which use medium pressure steam as hot fluid. From the reboilers, the steam condensate is sent to the steam condensate drums, hence to the condensate return header. The bottom product, with the required RVP/TVP and $H_2S$ content, is delivered to the wet/dry heat exchangers through the stabilizer bottom pumps. The gas from the top of the column is sent to the LP gas compressor.

Slugging can cause process instabilities. For example, when a slug of oil is arriving, the oil level in GOSP will rise while the water level and gas pressure may fall. Similarly, when a pocket of gas is arriving, the pressure in GOSP will go high and oil and water may fall, which could potentially lead to a plant trip.

Figure 2:
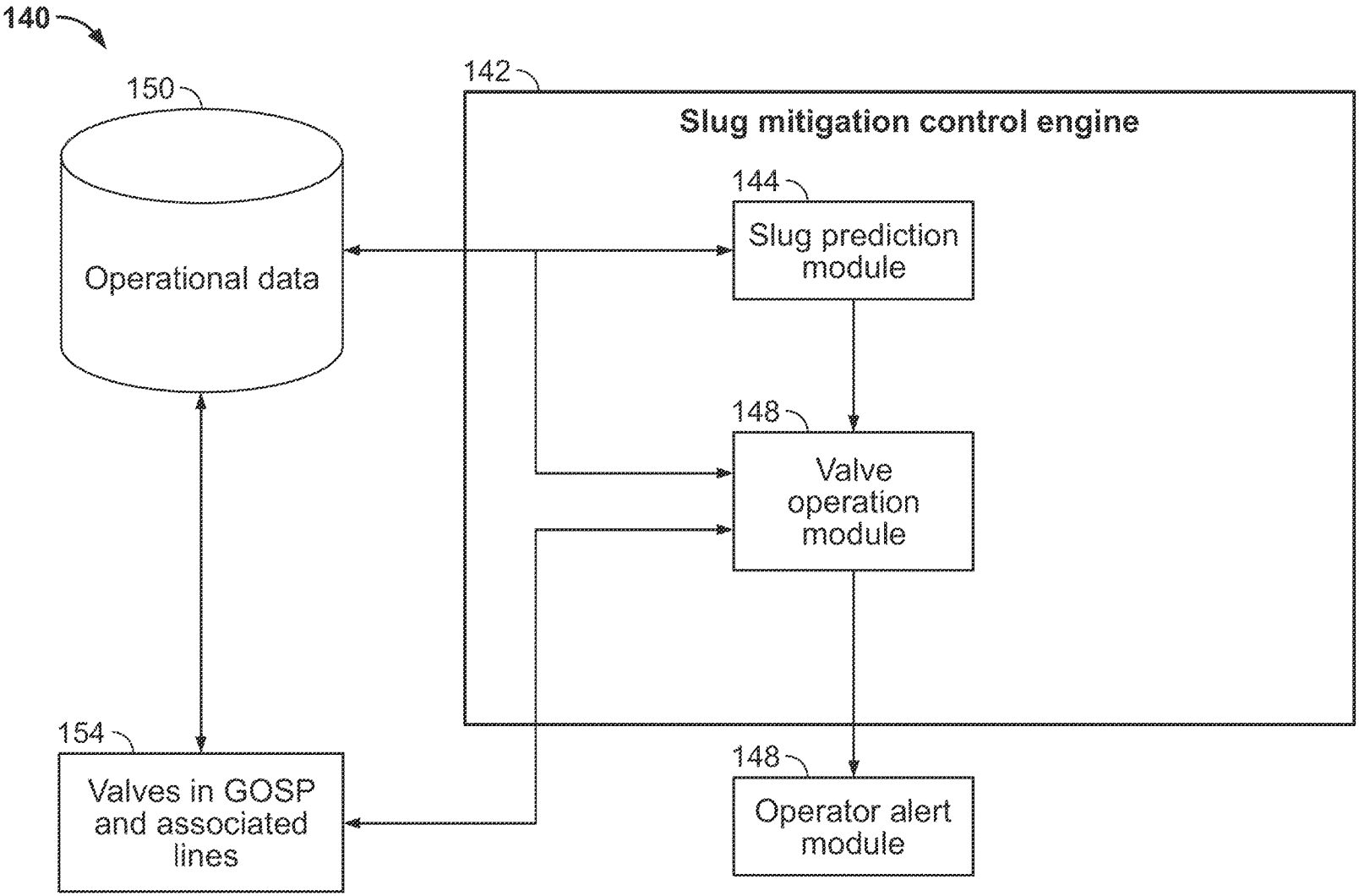
FIG. 2 is an example system used to implement processes for mitigating flow variability and slugging in the GOSP.

FIG. 2 is a schematic illustrating an example system used to implement processes for mitigating flow variability and slugging. Modules of the system and communication between modules is described with reference to this figure but the actual implementations of the individual modules are described later in this specification. Some systems are implemented with different modules and/or different communication between modules.

The system 140 can be implemented in computer processors located in a control center, for example, of a GOSP. The system 140 includes a slug mitigation control engine 142 which includes slug prediction module 144 and a valve operation module 148. The slug mitigation control engine 142 is in communication with a data store 150 that contains upstream flow volumes, input flows, and operating conditions of the GOSP (e.g., multi-phase flow meter volumetric flows of gas, oil and water, inlet manifold pressures, oil and water levels, and gas pressure at various locations through the GOSP). The slug mitigation control engine 142 (e.g., through Supervisory Control and Data Acquisition (SCADA) systems) communicates with machine operated valves control flow upstream of the GOSP. Some systems include more or fewer data stores and/or organize input and output data differently.

The upstream flow volumes, input flows, and operating conditions stored in the data store 150 are provided to the slug prediction module 144. The slug prediction module 144 includes one or more machine learning models based on historical data associating upstream flow volumes, input flows (e.g., multi-phase flow meter volume flow readings of oil, water and gas of production wells) and pressure and temperatures at various locations in the trunk-lines), and operating conditions (e.g., inlet manifold pressures, GOSP fluid levels, and GOSP oil, gas and water flows) with specific volumes and characteristics of feed gas arriving at the GOSP 114. The slug prediction module 144 determines predicted incoming feed gas volumes. The predicted incoming feed gas volumes stored in the data store 150 and provided to the valve operation module 148 as input.

The valve operation module 148 includes one or more machine learning models based on historical data associating upstream flow volumes, input flows, and operating conditions with specific volumes and characteristics feed gas of feed gas arriving at the GOSP 114. The valve operation module 148 receives and processes the upstream flow volumes, input flows, and operating conditions to determine the valve operation strategies as described in more detail with reference to FIG. 4.

In the illustrated system 140, the slug mitigation control engine 142 sends instructions to the MOVs of the manifolds 116. In operation, MOVs of the manifolds 116 generate data that is communicated back to the data store 150 and the slug mitigation control engine 142.

As previously mentioned, slugging causes process instabilities. For example, when a slug of oil is arriving, the oil level in GOSP will rise while the water level and gas pressure may fall. Similarly, when a pocket of gas is arriving, the pressure in GOSP will go high and oil and water may fall, which could potentially lead to a plant trip.

By providing the ability to predict imminent arrival of slugs, the slug mitigation control engine 142 enables GOSP to control the MOVs 117 to throttle back ahead of time. By restricting the rate at which slugs arrive, the GOSP control systems have more time to react which reduces the likelihood of GOSPs tripping offline due to upstream slugs.

Figure 3:
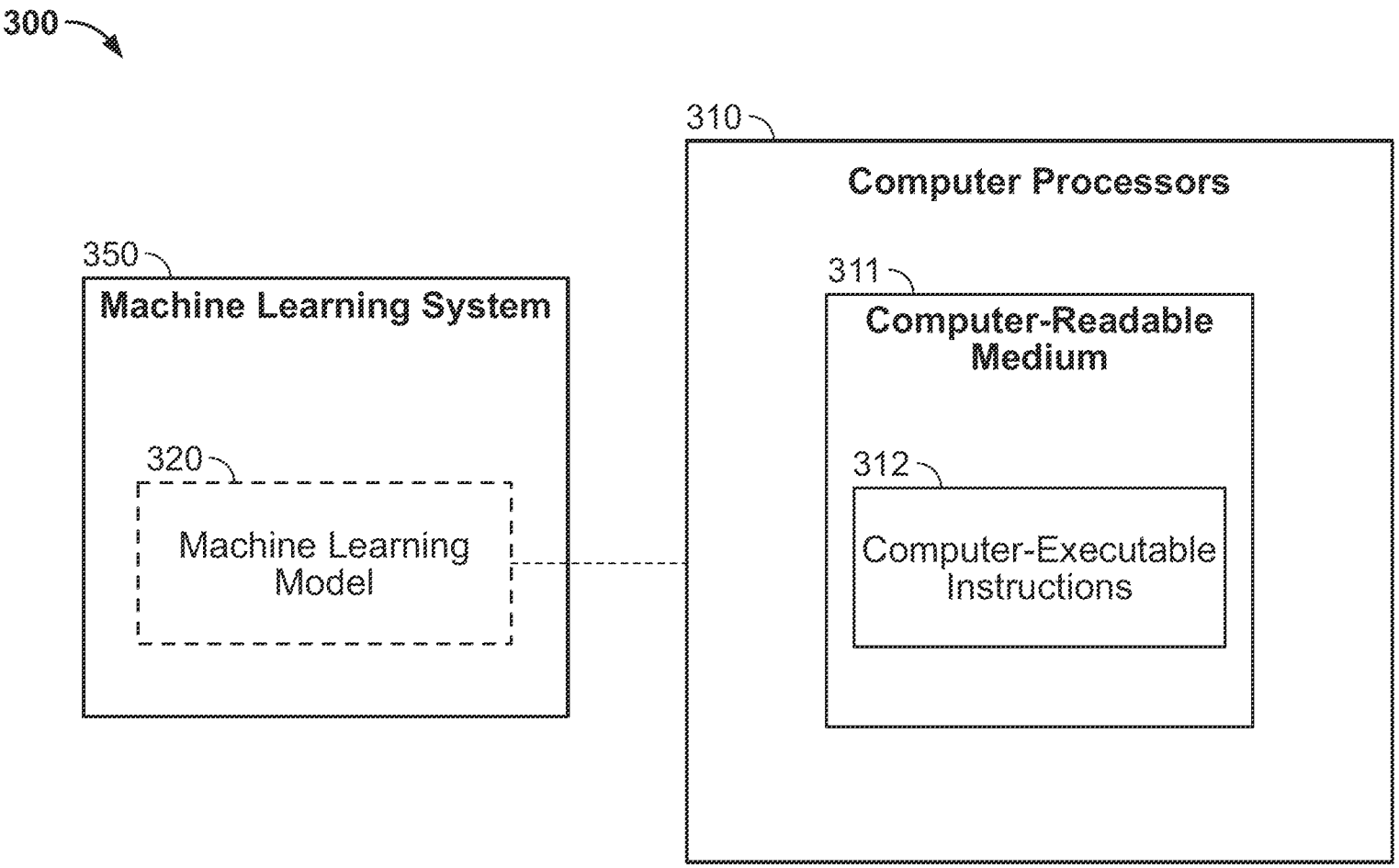
FIG. 3 is a diagram illustrating an example computer system 300 configured to execute a machine learning model.

FIG. 3 is a diagram illustrating an example computer system 300 configured to execute a machine learning model. Generally, the computer system 300 is configured to process data (e.g., upstream flow volumes, input flows, and operating conditions) indicating the volume and characteristics of feed gas arriving at the GOSP 114. The system 300 includes computer processors 310. The computer processors 310 include computer-readable memory 311 and computer readable instructions 312. The system 300 also includes a machine learning system 350. The machine learning system 350 includes a machine learning model 320. The machine learning model 320 can be separate from or integrated with the computer processors 310.

The computer-readable medium 311 (or computer-readable memory) can include any data storage technology type which is suitable to the local technical environment, including but not limited to semiconductor based memory devices, magnetic memory devices and systems, optical memory devices and systems, fixed memory, removable memory, disc memory, flash memory, dynamic random-access memory (DRAM), static random-access memory (SRAM), electronically erasable programmable read-only memory (EEPROM) and the like. In an embodiment, the computer-readable medium 311 includes code-segment having executable instructions.

In some implementations, the computer processors 310 include a general purpose processor. In some implementations, the computer processors 310 include a central processing unit (CPU). In some implementations, the computer processors 310 include at least one application specific integrated circuit (ASIC). The computer processors 310 can also include general purpose programmable microprocessors, graphic processing units, special-purpose programmable microprocessors, digital signal processors (DSPs), programmable logic arrays (PLAs), field programmable gate arrays (FPGA), special purpose electronic circuits, etc., or a combination thereof. The computer processors 310 are configured to execute program code means such as the computer-executable instructions 312 and configured to execute executable logic that includes the machine learning model 320.

The computer processors 310 are configured to receive data including, e.g., multi-phase flow meter volumetric flows of gas, oil and water, inlet manifold pressures, oil and water levels, and gas pressure at various locations through the GOSP. The machine learning model 320 of the slug prediction module 144 is capable of processing the data to predict volumes and characteristics of feed gas at the GOSP 114.

The machine learning system 350 is capable of applying machine learning techniques to train the machine learning model 320. As part of the training of the machine learning model 320, the machine learning system 350 forms a training set of input data by identifying a positive training set of input data items that have been determined to have the property in question, and, in some embodiments, forms a negative training set of input data items that lack the property in question.

The machine learning system 350 extracts feature values from the input data of the training set, the features being variables deemed potentially relevant to whether or not the input data items have the associated property or properties. An ordered list of the features for the input data is herein referred to as the feature vector for the input data. In one embodiment, the machine learning system 350 applies dimensionality reduction (e.g., via linear discriminant analysis (LDA), principle component analysis (PCA), or the like) to reduce the amount of data in the feature vectors for the input data to a smaller, more representative set of data.

In some implementations, the machine learning system 350 uses supervised machine learning to train the machine learning models 320 with the feature vectors of the positive training set and the negative training set serving as the inputs. Different machine learning techniques-such as linear support vector machine (linear SVM), boosting for other algorithms (e.g., AdaBoost), neural networks, logistic regression, naïve Bayes, memory-based learning, random forests, bagged trees, decision trees, boosted trees, or boosted stumps—may be used in different embodiments. The machine learning model 320, when applied to the feature vector extracted from the input data item, outputs an indication of whether the input data item has the property in question, such as a Boolean yes/no estimate, or a scalar value representing a probability.

In some embodiments, a validation set is formed of additional input data, other than those in the training sets, which have already been determined to have or to lack the property in question. The machine learning system 350 applies the trained machine learning model 320 to the data of the validation set to quantify the accuracy of the machine learning model 320. Common metrics applied in accuracy measurement include: Precision=TP/(TP+FP) and Recall=TP/(TP+FN), where precision is how many the machine learning model correctly predicted (TP or true positives) out of the total it predicted (TP+FP or false positives), and recall is how many the machine learning model correctly predicted (TP) out of the total number of input data items that did have the property in question (TP+FN or false negatives). The F score (F-score=2*PR/(P+R)) unifies precision and recall into a single measure. In one embodiment, the machine learning module iteratively re-trains the machine learning model until the occurrence of a stopping condition, such as the accuracy measurement indication that the model is sufficiently accurate, or a number of training rounds having taken place.

In some implementations, the machine learning model 320 is a convolutional neural network (CNN). A CNN can be configured based on a presumption that inputs to the CNN correspond to image pixel data for an image or other data that includes features at multiple spatial locations. For example, sets of inputs can form a multi-dimensional data structure, such as a tensor, that represent color features of an example digital image (e.g., a biological image of biological tissue). In some implementations, inputs to the CNN correspond to a variety of other types of data, such as data obtained from different devices and sensors of a vehicle, point cloud data, audio data that includes certain features or raw audio at each of multiple time steps, or various types of one-dimensional or multiple dimensional data. A convolutional layer of the CNN can process the inputs to transform features of the image that are represented by inputs of the data structure. For example, the inputs are processed by performing dot product operations using input data along a given dimension of the data structure and a set of parameters for the convolutional layer.

Performing computations for a convolutional layer can include applying one or more sets of kernels to portions of inputs in the data structure. The manner in which CNN performs the computations can be based on specific properties for each layer of an example multi-layer neural network or deep neural network that supports deep neural net workloads. A deep neural network can include one or more convolutional towers (or layers) along with other computational layers. In particular, for example computer vision applications, these convolutional towers often account for a large proportion of the inference calculations that are performed. Convolutional layers of a CNN can have sets of artificial neurons that are arranged in three dimensions, a width dimension, a height dimension, and a depth dimension. The depth dimension corresponds to a third dimension of an input or activation volume and can represent respective color channels of an image. For example, input images can form an input volume of data (e.g., activations), and the volume has dimensions 32×32×3 (width, height, depth respectively). A depth dimension of 3 can correspond to the RGB color channels of red (R), green (G), and blue (B).

In general, layers of a CNN are configured to transform the three dimensional input volume (inputs) to a multi-dimensional output volume of neuron activations (activations). For example, a 3D input structure of 32×32×3 holds the raw pixel values of an example image, in this case an image of width 32, height 32, and with three color channels, R,G,B. A convolutional layer of a CNN of the machine learning model 320 computes the output of neurons that may be connected to local regions in the input volume. Each neuron in the convolutional layer can be connected only to a local region in the input volume spatially, but to the full depth (e.g., all color channels) of the input volume. For a set of neurons at the convolutional layer, the layer computes a dot product between the parameters (weights) for the neurons and a certain region in the input volume to which the neurons are connected. This computation may result in a volume such as 32×32×12, where 12 corresponds to a number of kernels that are used for the computation. A neuron's connection to inputs of a region can have a spatial extent along the depth axis that is equal to the depth of the input volume. The spatial extent corresponds to spatial dimensions (e.g., x and y dimensions) of a kernel.

A set of kernels can have spatial characteristics that include a width and a height and that extends through a depth of the input volume. Each set of kernels for the layer is applied to one or more sets of inputs provided to the layer. That is, for each kernel or set of kernels, the machine learning model 320 can overlay the kernel, which can be represented multi-dimensionally, over a first portion of layer inputs (e.g., that form an input volume or input tensor), which can be represented multi-dimensionally. For example, a set of kernels for a first layer of a CNN may have size 5×5×3×16, corresponding to a width of 5 pixels, a height of 5 pixel, a depth of 3 that corresponds to the color channels of the input volume to which to a kernel is being applied, and an output dimension of 16 that corresponds to a number of output channels. In this context, the set of kernels includes 16 kernels so that an output of the convolution has a depth dimension of 16.

The machine learning model 320 can then compute a dot product from the overlapped elements. For example, the machine learning model 320 can convolve (or slide) each kernel across the width and height of the input volume and compute dot products between the entries of the kernel and inputs for a position or region of the image. Each output value in a convolution output is the result of a dot product between a kernel and some set of inputs from an example input tensor. The dot product can result in a convolution output that corresponds to a single layer input, e.g., an activation element that has an upper-left position in the overlapped multi-dimensional space. As discussed above, a neuron of a convolutional layer can be connected to a region of the input volume that includes multiple inputs. The machine learning model 320 can convolve each kernel over each input of an input volume. The machine learning model 320 can perform this convolution operation by, for example, moving (or sliding) each kernel over each input in the region.

The machine learning model 320 can move each kernel over inputs of the region based on a stride value for a given convolutional layer. For example, when the stride is set to 1, then the machine learning model 320 can move the kernels over the region one pixel (or input) at a time. Likewise, when the stride is 2, then the machine learning model 320 can move the kernels over the region two pixels at a time. Thus, kernels may be shifted based on a stride value for a layer and the machine learning model 320 can repeatedly perform this process until inputs for the region have a corresponding dot product. Related to the stride value is a skip value. The skip value can identify one or more sets of inputs (2×2), in a region of the input volume, that are skipped when inputs are loaded for processing at a neural network layer. In some implementations, an input volume of pixels for an image can be "padded" with zeros, e.g., around a border region of an image. This zero-padding is used to control the spatial size of the output volumes.

As discussed previously, a convolutional layer of CNN is configured to transform a three dimensional input volume (inputs of the region) to a multi-dimensional output volume of neuron activations. For example, as the kernel is convolved over the width and height of the input volume, the machine learning model 320 can produce a multi-dimensional activation map that includes results of convolving the kernel at one or more spatial positions based on the stride value. In some cases, increasing the stride value produces smaller output volumes of activations spatially. In some implementations, an activation can be applied to outputs of the convolution before the outputs are sent to a subsequent layer of the CNN.

An example convolutional layer can have one or more control parameters for the layer that represent properties of the layer. For example, the control parameters can include a number of kernels, K, the spatial extent of the kernels, F, the stride (or skip), S, and the amount of zero padding, P. Numerical values for these parameters, the inputs to the layer, and the parameter values of the kernel for the layer shape the computations that occur at the layer and the size of the output volume for the layer. In some implementations, the spatial size of the output volume is computed as a function of the input volume size, W, using the formula (W?F+2P)/S+1. For example, an input tensor can represent a pixel input volume of size [227×227×3]. A convolutional layer of a CNN can have a spatial extent value of F=11, a stride value of S=4, and no zero-padding (P=0). Using the above formula and a layer kernel quantity of K=96, the machine learning model 320 performs computations for the layer that results in a convolutional layer output volume of size [55×55×96], where 55 is obtained from [(227−11+0)/4+1=55].

The computations (e.g., dot product computations) for a convolutional layer, or other layers, of a CNN involve performing mathematical operations, e.g., multiplication and addition, using a computation unit of a hardware circuit of the machine learning model 320. The design of a hardware circuit can cause a system to be limited in its ability to fully utilize computing cells of the circuit when performing computations for layers of a neural network.

Figure 4:
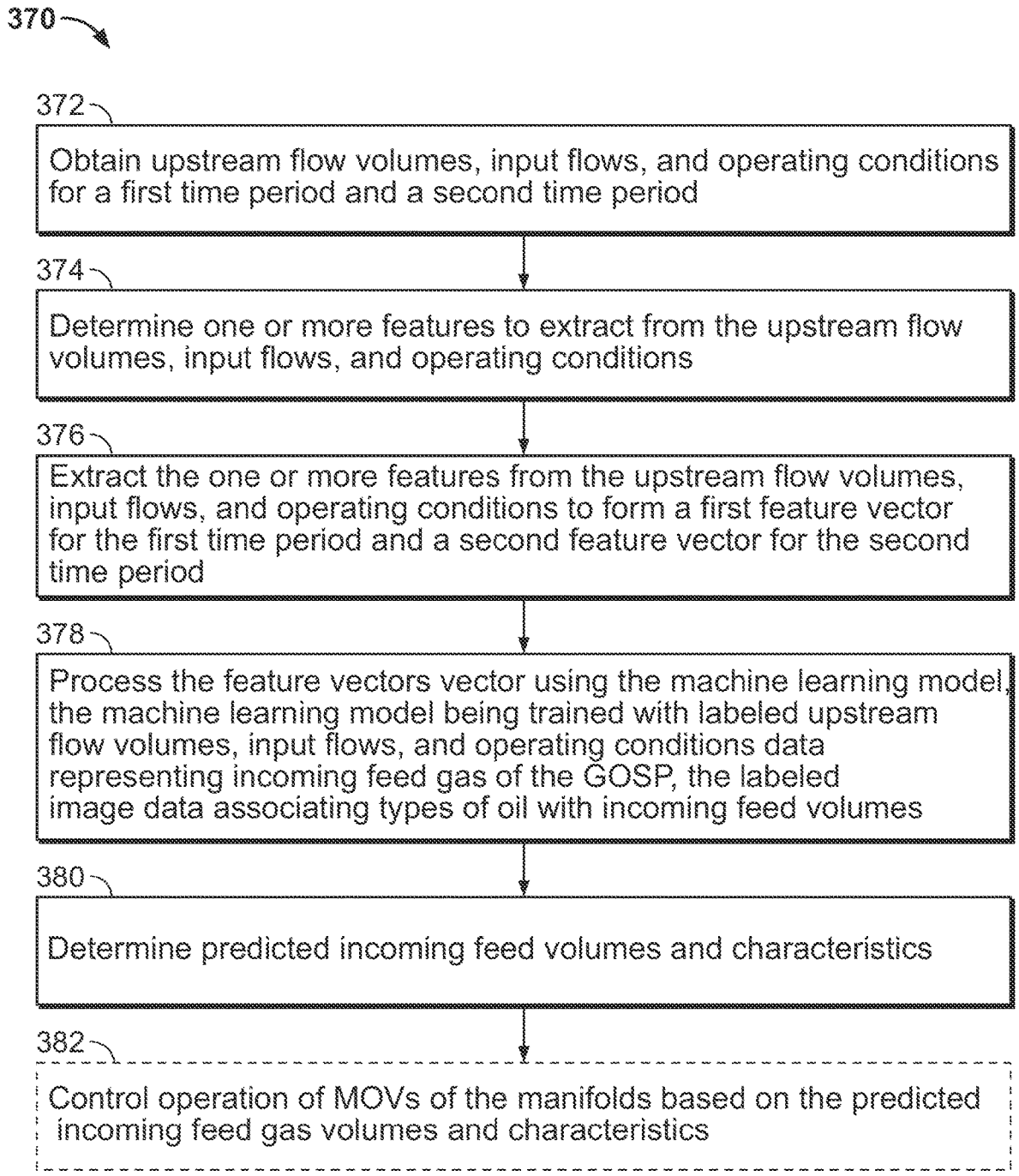
FIG. 4 is a flowchart illustrating operation of a slug mitigation control engine.

FIG. 4 illustrates an example flow diagram for an identification module of the system of FIG. 2. The method 360 is implemented with the slug prediction module 144 monitoring upstream flow volumes, input flows, and operating conditions. The slug prediction module 144 includes one or more machine learning models based on historical data associating upstream flow volumes, input flows, and operating conditions with clients and characteristics of feed gas. A prototype of the slug prediction module 144 has been developed using upstream flow volumes, input flows, and operating conditions from a refinery complex including an GOSP in Saudi Arabia. Data processed by the machine learning models of the prototype of the slug prediction module 144 include, e.g., multi-phase flow meter volumetric flows of gas, oil and water, inlet manifold pressures, oil and water levels, and gas pressure at various locations through the GOSP.

The monitoring process includes obtaining upstream flow volumes, input flows, and operating conditions for a first time period and a second time period (step 372). The machine learning models of the slug prediction module 144 determine one or more features to extract from the upstream flow volumes, input flows, and operating conditions (step 374). These features represent physical features of a hydrocarbon complex for each of the first time period and the second time period. The features are extracted from the images to form a first feature vector for the first time period and a second feature vector for the second time period (step 376).

The slug prediction module 144 includes one or machine learning models trained with labeled upstream flow volumes, input flows, and operating conditions data representing hydrocarbon complex conditions in the historic data. The labeled image data associates upstream flow volumes, input flows, and operating conditions with volumes and characteristics of feed gas in the first and second vectors. Although the prototype of the slug prediction module 144 was trained on data from a specific facility, the slug prediction module 144 can be trained on data from other facilities.

A specific machine learning model is selected based on the one or more features included in the first feature vector and the second feature vector. The selected machine learning model processes the first feature vector and the second feature vector (step 378) and determines, based on the processing, volumes and characteristics of feed gas (step 380). The results of this process (e.g., volumes and characteristics of feed gas) are stored in the data store 150 in association with the upstream flow volumes, input flows, and operating conditions and used by the control system to control operation of MOVs of the manifolds based on the predicted incoming feed gas volumes and characteristics (step 382).

Figure 5:
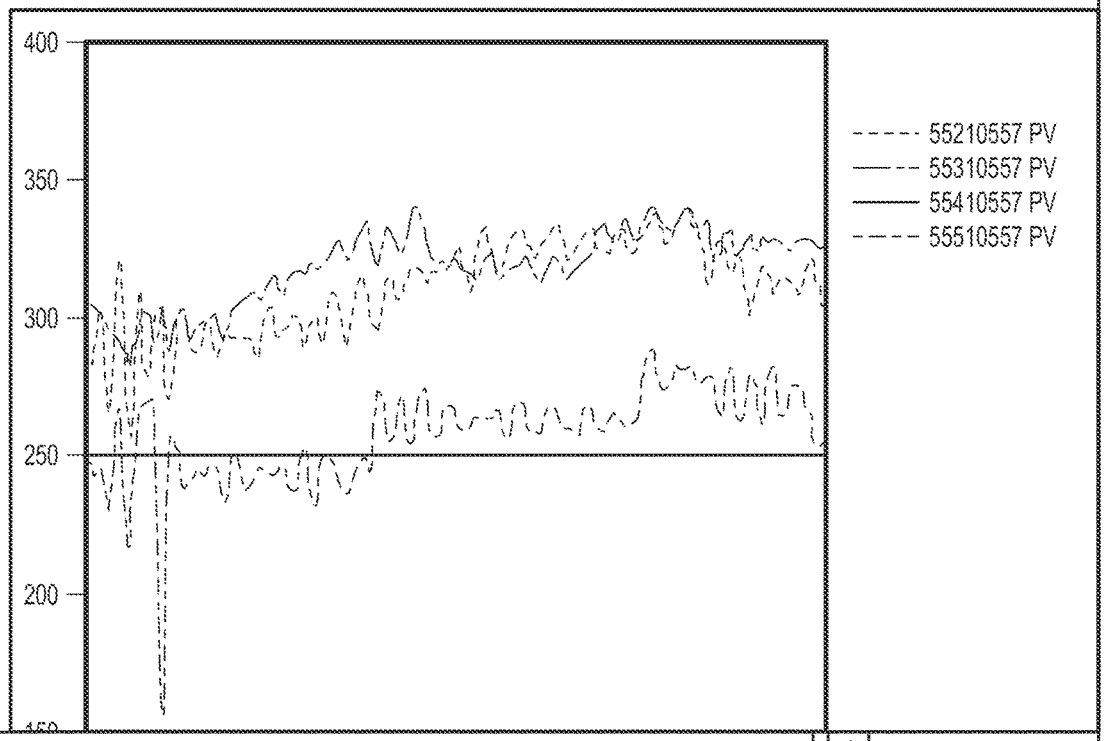
FIG. 5 is a display generated by a prototype of the system of FIG. 3.

FIG. 5 illustrates a display 400 generated by a prototype of the system for mitigating flow variations and slugging. The system is used to detect and propose or implement actions to alleviate the slugging. For example, specific MOVs can be chocked to reduce slugging and other MOVs opened to maintain required flowrates.

Figure 6:
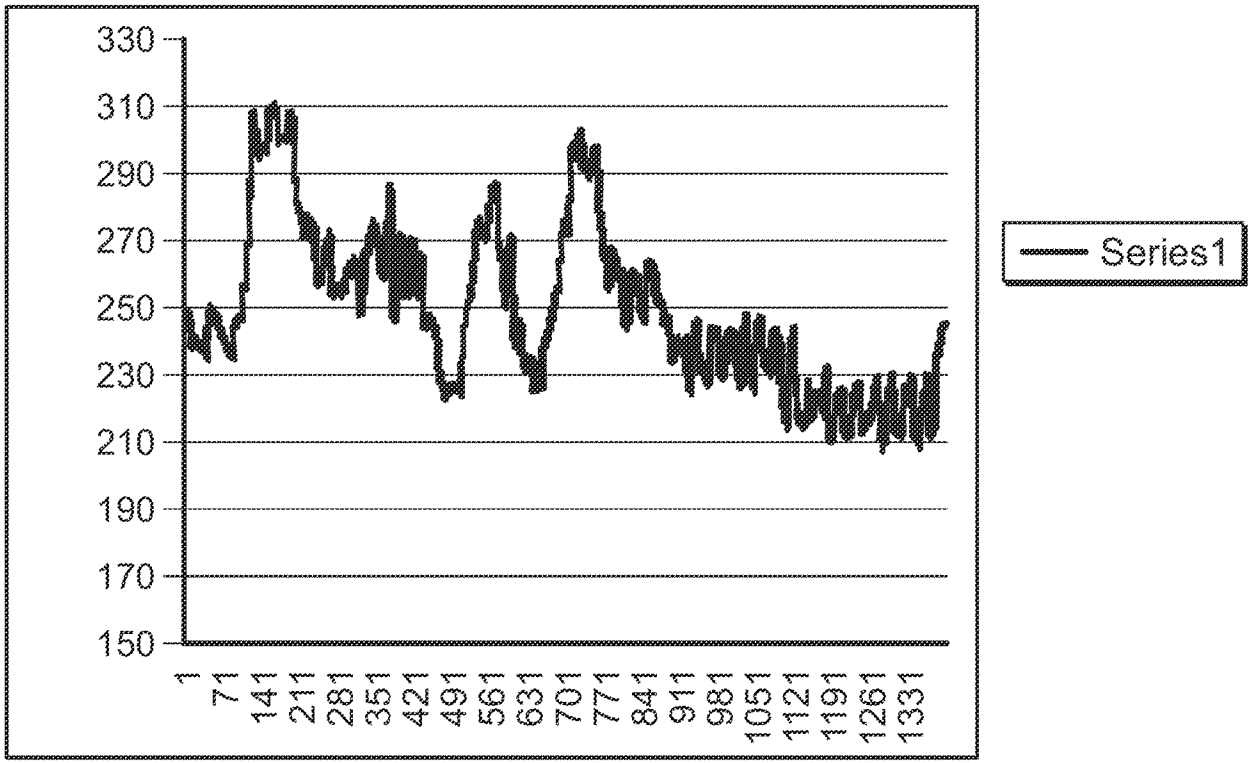
FIGS. 6 and 7 are charts illustrating the impact of use of the prototype in an OGSP.
Figure 7:
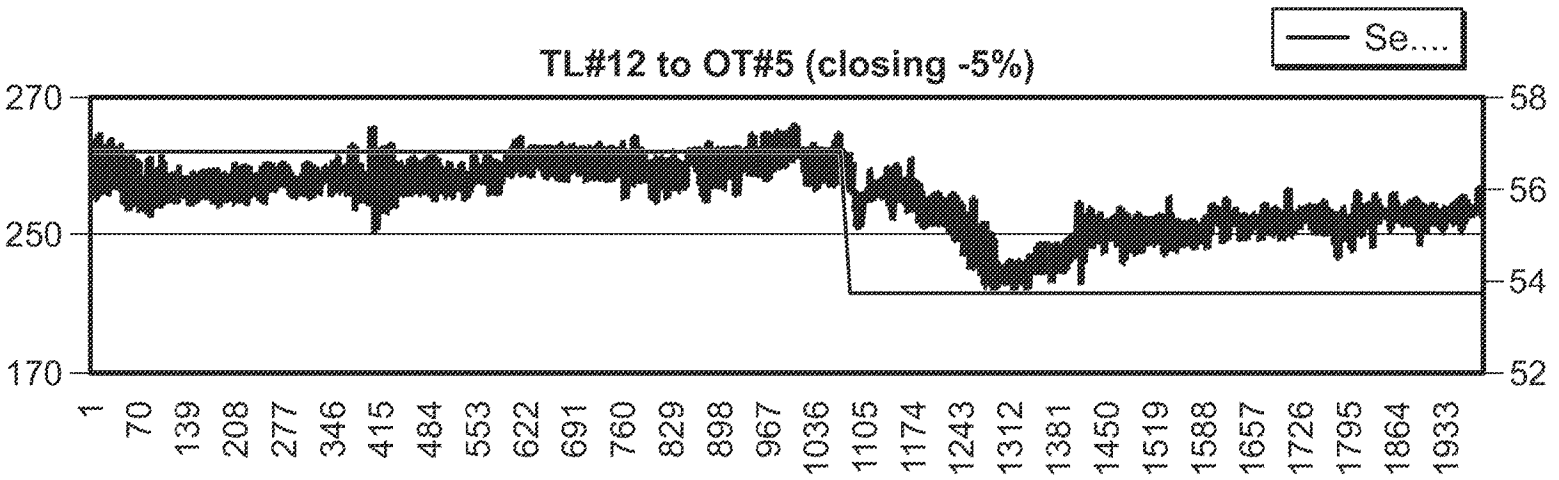
Figure 7:
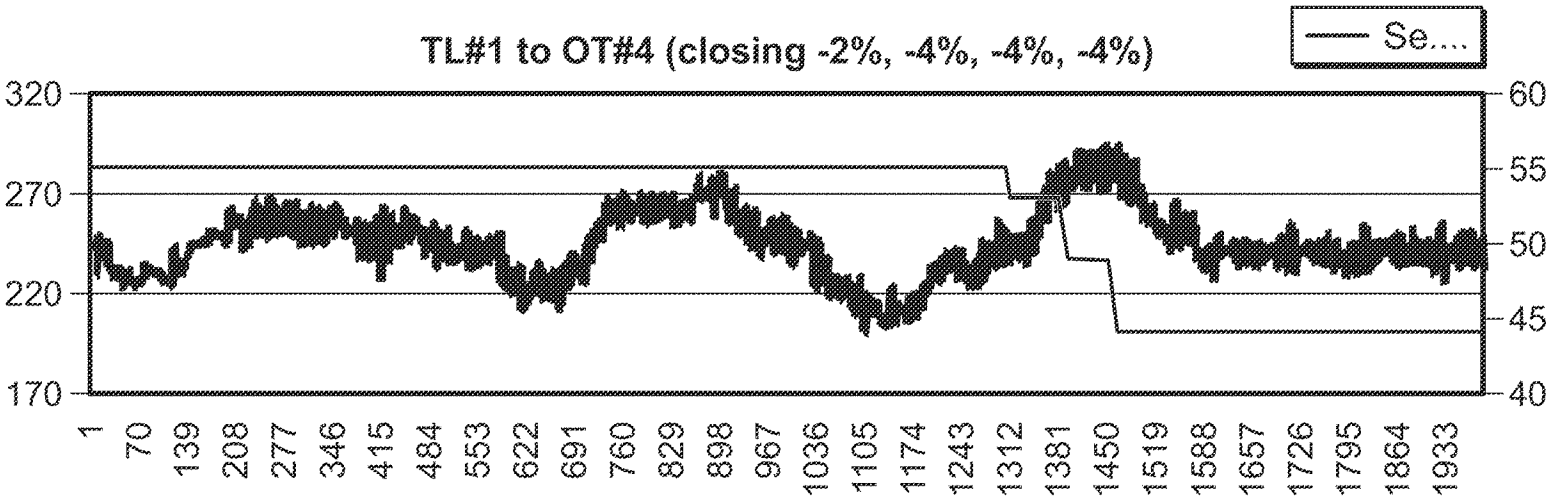

FIGS. 6 and 7 are charts illustrating the impact of use of the prototype in an OGSP.

FIG. 6 shows the regression model output using the training data set. This chart 500 compares actual and predicted incoming feed gas volumes of generated by the slug prediction module of a prototype system using the training data set.

FIG. 7 shows the regression model output being checked using the testing data set. This chart 510 compares actual and predicted incoming feed gas volumes of generated by the slug prediction module of the prototype system using the testing data set. As shown in FIG. 2, the predicted incoming feed gas values match the actual incoming seed gas for a wider range of data with an average prediction accuracy reaching ~95%.

Figure 8:
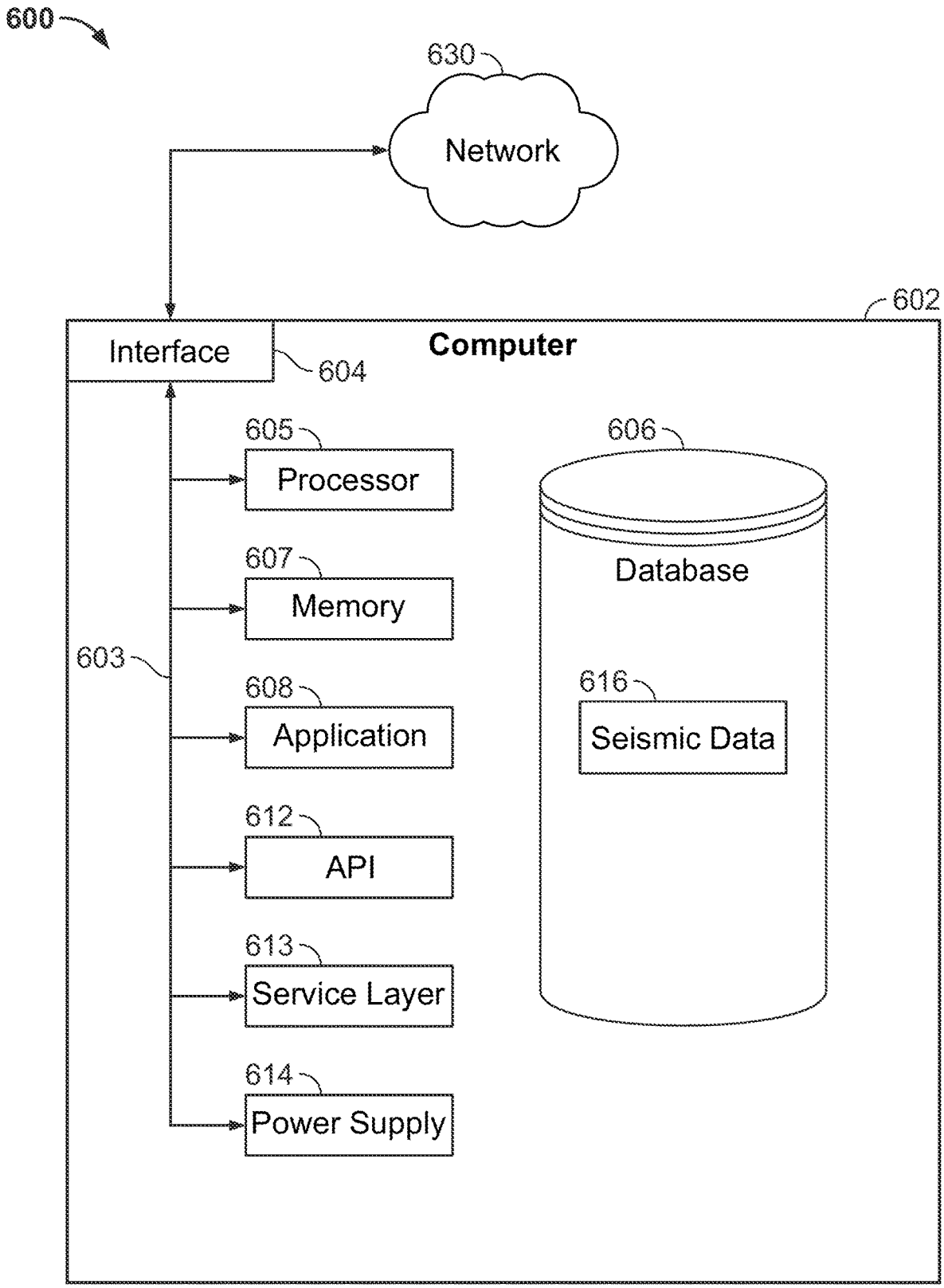
FIG. 8 is a block diagram illustrating an example computer system used to provide computational functionalities associated with described algorithms, methods, functions, processes, flows, and procedures according to some implementations of the present disclosure.

FIG. 8 is a block diagram of an example computer system 600 used to provide computational functionalities associated with described algorithms, methods, functions, processes, flows, and procedures described in the present disclosure, according to some implementations of the present disclosure. The illustrated computer 602 is intended to encompass any computing device such as a server, a desktop computer, a laptop/notebook computer, a wireless data port, a smart phone, a personal data assistant (PDA), a tablet computing device, or one or more processors within these devices, including physical instances, virtual instances, or both. The computer 602 can include input devices such as keypads, keyboards, and touch screens that can accept user information. Also, the computer 602 can include output devices that can convey information associated with the operation of the computer 602. The information can include digital data, visual data, audio information, or a combination of information. The information can be presented in a graphical user interface (UI) (or GUI).

The computer 602 can serve in a role as a client, a network component, a server, a database, a persistency, or components of a computer system for performing the subject matter described in the present disclosure. The illustrated computer 602 is communicably coupled with a network 630. In some implementations, one or more components of the computer 602 can be configured to operate within different environments, including cloud-computing-based environments, local environments, global environments, and combinations of environments.

At a high level, the computer 602 is an electronic computing device operable to receive, transmit, process, store, and manage data and information associated with the described subject matter. According to some implementations, the computer 602 can also include, or be communicably coupled with, an application server, an email server, a web server, a caching server, a streaming data server, or a combination of servers.

The computer 602 can receive requests over network 630 from a client application (for example, executing on another computer 602). The computer 602 can respond to the received requests by processing the received requests using software applications. Requests can also be sent to the computer 602 from internal users (for example, from a command console), external (or third) parties, automated applications, entities, individuals, systems, and computers.

Each of the components of the computer 602 can communicate using a system bus 603. In some implementations, any or all of the components of the computer 602, including hardware or software components, can interface with each other or the interface 604 (or a combination of both), over the system bus 603. Interfaces can use an application programming interface (API) 612, a service layer 613, or a combination of the API 612 and service layer 613. The API 612 can include specifications for routines, data structures, and object classes. The API 612 can be either computer-language independent or dependent. The API 612 can refer to a complete interface, a single function, or a set of APIs.

The service layer 613 can provide software services to the computer 602 and other components (whether illustrated or not) that are communicably coupled to the computer 602. The functionality of the computer 602 can be accessible for all service consumers using this service layer. Software services, such as those provided by the service layer 613, can provide reusable, defined functionalities through a defined interface. For example, the interface can be software written in JAVA, C++, or a language providing data in extensible markup language (XML) format. While illustrated as an integrated component of the computer 602, in alternative implementations, the API 612 or the service layer 613 can be stand-alone components in relation to other components of the computer 602 and other components communicably coupled to the computer 602. Moreover, any or all parts of the API 612 or the service layer 613 can be implemented as child or sub-modules of another software module, enterprise application, or hardware module without departing from the scope of the present disclosure.

The computer 602 includes an interface 604. Although illustrated as a single interface 604 in FIG. 6, two or more interfaces 604 can be used according to particular needs, desires, or particular implementations of the computer 602 and the described functionality. The interface 604 can be used by the computer 602 for communicating with other systems that are connected to the network 630 (whether illustrated or not) in a distributed environment. Generally, the interface 604 can include, or be implemented using, logic encoded in software or hardware (or a combination of software and hardware) operable to communicate with the network 630. More specifically, the interface 604 can include software supporting one or more communication protocols associated with communications. As such, the network 630 or the interface's hardware can be operable to communicate physical signals within and outside of the illustrated computer 602.

The computer 602 includes a processor 605. Although illustrated as a single processor 605 in FIG. 6, two or more processors 605 can be used according to particular needs, desires, or particular implementations of the computer 602 and the described functionality. Generally, the processor 605 can execute instructions and can manipulate data to perform the operations of the computer 602, including operations using algorithms, methods, functions, processes, flows, and procedures as described in the present disclosure.

The computer 602 also includes a database 606 that can hold data for the computer 602 and other components connected to the network 630 (whether illustrated or not). For example, database 606 can be an in-memory, conventional, or a database storing data consistent with the present disclosure. In some implementations, database 606 can be a combination of two or more different database types (for example, hybrid in-memory and conventional databases) according to particular needs, desires, or particular implementations of the computer 602 and the described functionality. Although illustrated as a single database 606 in FIG. 6, two or more databases (of the same, different, or combination of types) can be used according to particular needs, desires, or particular implementations of the computer 602 and the described functionality. While database 606 is illustrated as an internal component of the computer 602, in alternative implementations, database 606 can be external to the computer 602.

The computer 602 also includes a memory 607 that can hold data for the computer 602 or a combination of components connected to the network 630 (whether illustrated or not). Memory 607 can store any data consistent with the present disclosure. In some implementations, memory 607 can be a combination of two or more different types of memory (for example, a combination of semiconductor and magnetic storage) according to particular needs, desires, or particular implementations of the computer 602 and the described functionality. Although illustrated as a single memory 607 in FIG. 6, two or more memories 607 (of the same, different, or combination of types) can be used according to particular needs, desires, or particular implementations of the computer 602 and the described functionality. While memory 607 is illustrated as an internal component of the computer 602, in alternative implementations, memory 607 can be external to the computer 602.

The application 608 can be an algorithmic software engine providing functionality according to particular needs, desires, or particular implementations of the computer 602 and the described functionality. For example, application 608 can serve as one or more components, modules, or applications. Further, although illustrated as a single application 608, the application 608 can be implemented as multiple applications 608 on the computer 602. In addition, although illustrated as internal to the computer 602, in alternative implementations, the application 608 can be external to the computer 602.

The computer 602 can also include a power supply 614. The power supply 614 can include a rechargeable or non-rechargeable battery that can be configured to be either user- or non-user-replaceable. In some implementations, the power supply 614 can include power-conversion and management circuits, including recharging, standby, and power management functionalities. In some implementations, the power-supply 614 can include a power plug to allow the computer 602 to be plugged into a wall socket or a power source to, for example, power the computer 602 or recharge a rechargeable battery.

There can be any number of computers 602 associated with, or external to, a computer system containing computer 602, with each computer 602 communicating over network 630. Further, the terms "client," "user," and other appropriate terminology can be used interchangeably, as appropriate, without departing from the scope of the present disclosure. Moreover, the present disclosure contemplates that many users can use one computer 602 and one user can use multiple computers 602.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non transitory, computer-readable computer-storage medium for execution by, or to control the operation of, data processing apparatus. Alternatively, or additionally, the program instructions can be encoded in/on an artificially generated propagated signal. The example, the signal can be a machine-generated electrical, optical, or electromagnetic signal that is generated to encode information for transmission to suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatus, devices, and machines for processing data, including by way of example, a programmable processor, a computer, or multiple processors or computers. The apparatus can also include special purpose logic circuitry including, for example, a central processing unit (CPU), a field programmable gate array (FPGA), or an application specific integrated circuit (ASIC). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, for example LINUX, UNIX, WINDOWS, MAC OS, ANDROID, or IOS.

A computer program, which can also be referred to or described as a program, software, a software application, a module, a software module, a script, or code, can be written in any form of programming language. Programming languages can include, for example, compiled languages, interpreted languages, declarative languages, or procedural languages. Programs can be deployed in any form, including as stand-alone programs, modules, components, subroutines, or units for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files storing one or more modules, sub programs, or portions of code. A computer program can be deployed for execution on one computer or on multiple computers that are located, for example, at one site or distributed across multiple sites that are interconnected by a communication network. While portions of the programs illustrated in the various figures may be shown as individual modules that implement the various features and functionality through various objects, methods, or processes, the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory. A computer can also include, or be operatively coupled to, one or more mass storage devices for storing data. In some implementations, a computer can receive data from, and transfer data to, the mass storage devices including, for example, magnetic, magneto optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer readable media (transitory or non-transitory, as appropriate) suitable for storing computer program instructions and data can include all forms of permanent/non-permanent and volatile/non-volatile memory, media, and memory devices. Computer readable media can include, for example, semiconductor memory devices such as random access memory (RAM), read only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer readable media can also include, for example, magnetic devices such as tape, cartridges, cassettes, and internal/removable disks. Computer readable media can also include magneto optical disks and optical memory devices and technologies including, for example, digital video disc (DVD), CD ROM, DVD+/−R, DVD-RAM, DVD-ROM, HD-DVD, and BLU-RAY. The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated in, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), and a plasma monitor. Display devices can include a keyboard and pointing devices including, for example, a mouse, a trackball, or a trackpad. User input can also be provided to the computer through the use of a touchscreen, such as a tablet computer surface with pressure sensitivity or a multi-touch screen using capacitive or electric sensing. Other kinds of devices can be used to provide for interaction with a user, including to receive user feedback including, for example, sensory feedback including visual feedback, auditory feedback, or tactile feedback. Input from the user can be received in the form of acoustic, speech, or tactile input. In addition, a computer can interact with a user by sending documents to, and receiving documents from, a device that is used by the user. For example, the computer can send web pages to a web browser on a user's client device in response to requests received from the web browser.

The term "graphical user interface," or "GUI," can be used in the singular or the plural to describe one or more graphical user interfaces and each of the displays of a particular graphical user interface. Therefore, a GUI can represent any graphical user interface, including, but not limited to, a web browser, a touch screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back end component, for example, as a data server, or that includes a middleware component, for example, an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11 a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship.

Cluster file systems can be any file system type accessible from multiple servers for read and update. Locking or consistency tracking may not be necessary since the locking of exchange file system can be done at application layer. Furthermore, Unicode data files can be different from non-Unicode data files.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system comprising a computer memory interoperably coupled with a hardware processor configured to perform the computer-implemented method or the instructions stored on the non-transitory, computer-readable medium.

A number of embodiments of these systems and methods have been described. Nevertheless, it will be understood that various modifications may be made without departing from the spirit and scope of this disclosure. Accordingly, other embodiments are within the scope of the following claims.

What is claimed is:

1. A method for controlling fluid flow for mitigation of flow variations upstream of a gas oil separation plant, the method comprising:

obtaining first sensor data associated with one or more trunk lines;

obtaining second sensor data associated with a gas and oil separation plant (GOSP) configured to receive fluid from the one or more trunk lines;

wherein the first and second sensor data are obtained for a first time period and a second time period that is different than the first time period;

extracting one or more features from the first sensor data and the second sensor data based identified features of training data that trains a machine learning model associated with the GOSP, the training data comprising labeled data representing incoming feed gas of the GOSP, the labeled data associating upstream flow volumes, input flows, and operating conditions with incoming feed gas volumes;

generating, from the extracted one or more features, a first feature vector for the first time period and a second feature vector for the second time period;

processing, by a machine learning model, the first feature vector and the second feature vector, the machine learning model being trained with the training data;

determining, based on the processing, predicted incoming feed gas volumes; and controlling, based on the predicted incoming feed gas volumes, settings of machine operated valves upstream of the GOSP.

2. The method of claim 1, wherein extracting the features is based on principle component analysis of the training data comprising first sensor data and second sensor data.

3. The method of claim 2, wherein the first sensor data comprises values for process measurements including at least one of an upstream flow volume for each of the one or more trunk lines and an input flow volume from each of the one or more trunk lines.

4. The method of claim 3, wherein the second sensor data comprises one or more inlet manifold pressure values, one or more values of levels for oil, water, or gas, and a gas pressure value for at least one location in the GOSP.

5. The method of claim 1, wherein the first time period includes periods when crude trunk-line scraping activities are performed.

6. The method of claim 1, wherein controlling the settings of the machine operated valves upstream of the GOSP comprises chocking the machine operated valves of one or more trunk lines.

7. The method of claim 1, wherein controlling the settings of the machine operated valves upstream of the GOSP comprises directing certain trunk lines to a specific GOSP.

8. The method of claim 7, wherein controlling the settings of the machine operated valves upstream of the GOSP comprises splitting at least one trunk line into various GOSPs.

* * * * *